US007671308B2

(12) United States Patent
Kreisman et al.

(10) Patent No.: US 7,671,308 B2
(45) Date of Patent: Mar. 2, 2010

(54) CONTAINER TO FACILITATE MICROWAVE COOKING AND HANDLING

(75) Inventors: Linda R Kreisman, St. Paul, MN (US); Joanne J Garbe, Columbia Heights, MN (US); Peter Peschek, Maple Grove, MN (US); Judy Alich, Inver Grove Heights, MN (US); Doris Mae Lentner, Eden Prairie, MN (US)

(73) Assignee: General Mills, Inc., Minneapolis, MN (US)

( * ) Notice: Subject to any disclaimer, the term of this patent is extended or adjusted under 35 U.S.C. 154(b) by 662 days.

(21) Appl. No.: 11/332,492

(22) Filed: Jan. 13, 2006

(65) Prior Publication Data

US 2006/0191934 A1 Aug. 31, 2006

Related U.S. Application Data

(60) Provisional application No. 60/649,251, filed on Feb. 2, 2005.

(51) Int. Cl.
*H05B 6/80* (2006.01)

(52) U.S. Cl. ..... 219/730; 219/725; 219/732

(58) Field of Classification Search ..... 219/730–735; 220/258.5, 656–659

See application file for complete search history.

(56) References Cited

U.S. PATENT DOCUMENTS

| | | | | |
|---|---|---|---|---|
| 4,396,635 | A | 8/1983 | Roudebush et al. | |
| 4,419,377 | A | 12/1983 | Seward et al. | |
| 6,672,473 | B2 * | 1/2004 | Torniainen et al. | 220/657 |
| 6,717,121 | B2 * | 4/2004 | Zeng et al. | 219/730 |
| 7,154,073 | B2 * | 12/2006 | Iwai et al. | 219/730 |
| 2006/0191935 | A1 * | 8/2006 | Tuszkiewicz et al. | 220/258.5 |

* cited by examiner

*Primary Examiner*—Thor S Campbell
(74) *Attorney, Agent, or Firm*—John O'Toole; Kyle Peterson

(57) ABSTRACT

A container for use in microwave heating. The container includes a bottom and a sidewall extending upwardly from the bottom. The sidewall defines an interior and terminates at a staking wall. A flange extends from the stacking wall and includes an edge section and an upper section extending radially outward from the container.

20 Claims, 6 Drawing Sheets

CONTAINER TO FACILITATE MICROWAVE COOKING AND HANDLING

CROSS REFERENCE TO RELATED APPLICATIONS

This application claims priority to U.S. Provisional Patent Application Ser. No. 60/649,251, filed Feb. 2, 2005, entitled "CONTAINER TO FACILITATE MICROWAVE COOKING AND HANDLING", which is incorporated herein by reference.

FIELD OF THE INVENTION

The invention relates generally to containers suitable for edible products. More particularly, the invention relates to a container for baking dry mix, batter, and desserts in a microwave oven.

BACKGROUND OF THE INVENTION

Dry mixes were first introduced by General Mills during the late 1940's. They originated as a commercial mixture of dry ingredients that were intended to simplify and streamline the baking process. Prepared dry mixes for layer cakes are generally made by combining sugar, flour, shortening, leavening and other ingredients including perhaps milk solids, egg solids, flavoring and coloring to form a free-flowing granular mixture. To prepare cake batters from these dry mixes for baking, liquid materials such as water, liquid shortening, milk and eggs are added and the combination is then beaten both to form a homogeneous mixture and to incorporate air. The resulting batter is then baked for a pre-determined amount of time at a specific temperature in a conventional oven.

In response to consumer demands for convenience, a wide variety of pre-made food items have been designed for heating in a microwave oven. Popular examples of these items include lasagna, cheese macaroni dishes, and vegetable casseroles. Batters from consumer culinary mixes designed for conventional oven baking can also be microwave baked. However, microwave baking presents unique challenges that are not encountered with conventional ovens. As a result, the application of microwave technology to dry mix desserts has been somewhat slower to develop.

When a conventional dry mix designed for oven baking is prepared into a batter and baked in a microwave, the finished layer cake texture can be fine textured and spongy. Often, specific gravities are much higher and pronounced variations from edge to center are observed. Moreover, the center of the microwave-prepared cake can be soggy and dense, while the edges are often overly dry. This is especially true in larger sized containers. Center point depressions can also occur.

Many of the deficiencies in finished layer cake quality can be attributed to the fundamental differences in the baking mechanisms between conventional ovens and microwave ovens. Conventional ovens rely on three methods for transferring heat—conduction, convection, and radiance. Conduction transfers heat through direct contact of a hot surface to a cold one. Convection transfers heat by moving a hot material such as air. Radiant heat transfer works by transmitting heat energy in a radiant form, similar to the way light is transmitted.

In contrast, microwave ovens do not transfer heat to a material. Rather, the material is induced to heat itself as the microwave oven generates a continually changing electrical field. When material is exposed to this electrical field, polar molecules gradually align. The resistance encountered during this alignment is converted to heat.

In microwave baking, the dish and the solid ingredients are relatively microwave inert and are heated at a slower rate, while the liquids, especially the moisture, are heated more rapidly than the solid ingredients. In direct contrast, in oven baking, the dish and solid structure are heated relatively quickly while the moisture is heated more slowly. Also, microwave energy has a limited depth of penetration. Microwave energy can interact with cake ingredients to cause deleterious textural changes in the finished product. Moreover, while both conventional and microwave oven baking dry mixes include flour, sugar, shortening and flavorings, each ingredient's different molecular makeup gives it unique heating properties in the microwave oven. For example, when various dry mix suspensions are heated with microwave energy, they tend to bubble-up onto the rim of the container. This characteristic of microwave cooking is particularly troublesome because a consumer may inadvertently grasp the container at the rim and experience discomfort from the hot food product.

Unfortunately the standard thermoformed plastic container design used to prepare dry mix desserts does not account for the tendency of product to bubble up onto the rim of the container.

SUMMARY OF THE INVENTION

The invention includes a container for use in microwave heating. The container includes a bottom and a sidewall defining an interior. The sidewall extends upwardly from the bottom and terminates at a rim having a collar and a stacking wall. A flange extends from the stacking wall. The flange includes an edge section and an upper section. The upper section extends radially outward from the container.

In another embodiment, the invention includes a food package comprising a container including a bottom and a sidewall defining an interior. The sidewall extends upwardly from the bottom and terminates at a rim having a collar and a stacking wall. A flange extends from the stacking wall. The flange includes an edge section and an upper section extending radially outward from the container. An intermediary food product is disposed in the container. A sleeve holds the container therein and includes a sleeve top and a sleeve base. The sleeve also contains an aperture which has a portion of the flange disposed therethrough.

In yet another embodiment, the invention includes a food package kit comprising a container including a bottom and a sidewall defining an interior. The sidewall extends upwardly from the bottom and terminates at a rim having a collar and a stacking wall. A flange extends from the stacking wall. The flange includes an edge section and an upper section extending radially outward from the container. At least one intermediary food component is located proximate to the container. The invention also includes a means for maintaining the intermediary food component proximate to the container.

The invention also includes a method of preparing a single serve food product. The method includes the steps of providing a container including a sidewall defining an interior. The sidewall of the container extends upwardly from the bottom and terminates at a rim having a collar and a stacking wall. A flange extends from the stacking wall. The flange includes an edge section and an upper section extending radially outward from the container. The method also includes the steps of placing at least one intermediary food product in the interior of the container and sealing the intermediary food product, or products, into the interior of the container with a wrapper.

In yet another embodiment, the invention includes a method of preparing food for subsequent sale. The method comprising the steps of providing a container including a bottom and a sidewall defining an interior. The sidewall of the container extends upwardly from the bottom and terminates at a rim having a collar and a stacking wall. A flange extends from the stacking wall. The flange includes an edge section and an upper section extending radially outward from the container. The method also includes the steps of placing at least one food product in the interior of the container and sealing the food product into the interior of the container with a wrapper. Furthermore, the method includes the step of sealing a sleeve around a plurality of sealed containers.

BRIEF DESCRIPTION OF THE DRAWINGS

The invention may be more completely understood in consideration of the following detailed description of various embodiments of the invention in connection with the accompanying drawings, in which.

Figure 1:
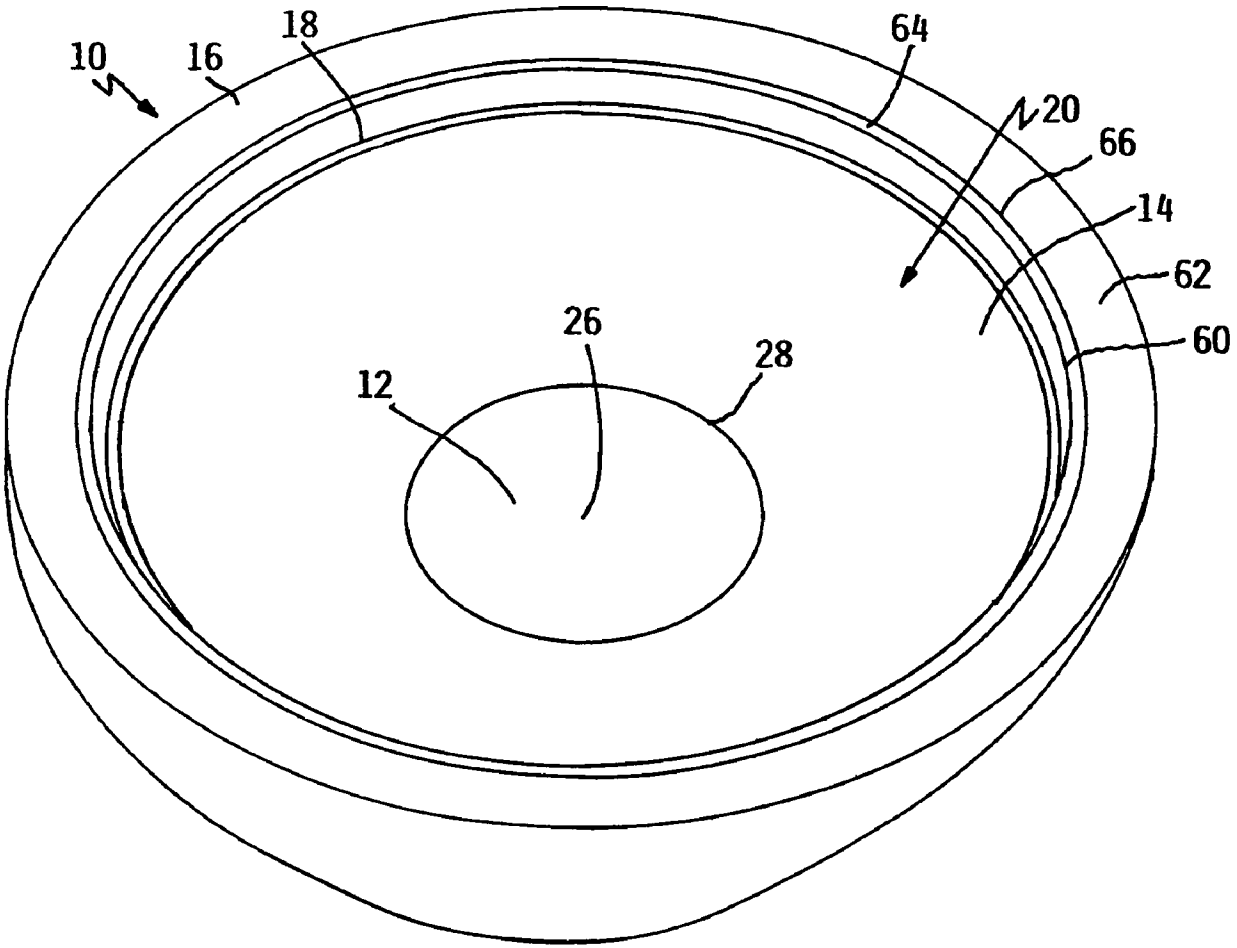
FIG. 1 shows an isometric view of a microwaveable container pursuant to the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

A microwavable food container in accordance with the invention is shown in FIGS. 1-4. Container 10 is generally defined by a bottom 12, a sidewall 14, a flange 16 and a rim 18. Container 10 is an integrally thermoformed plastic material, such as polyolefins (e.g., polypropylene, polyethylene), blends of polyolefins, polystyrene—HIPS, or polyester resin-based materials—CPET, foamed polypropylene, polyethylene), blends of polyolefin's polystyrene—HIPS, or polyester resin-based materials—CPET, paper and paper laminations with polypropylene, polyester, etc. In an alternative embodiment, container 10 may be fabricated using known injection molding or compression molding techniques. Sidewall 14 extends upwardly from bottom 12, defining an interior 20 for containing a dry mix (not shown). Rim 18 is located at the top of sidewall 14. Flange 16 extends radially outwardly relative to the top of rim 18.

Figure 4:
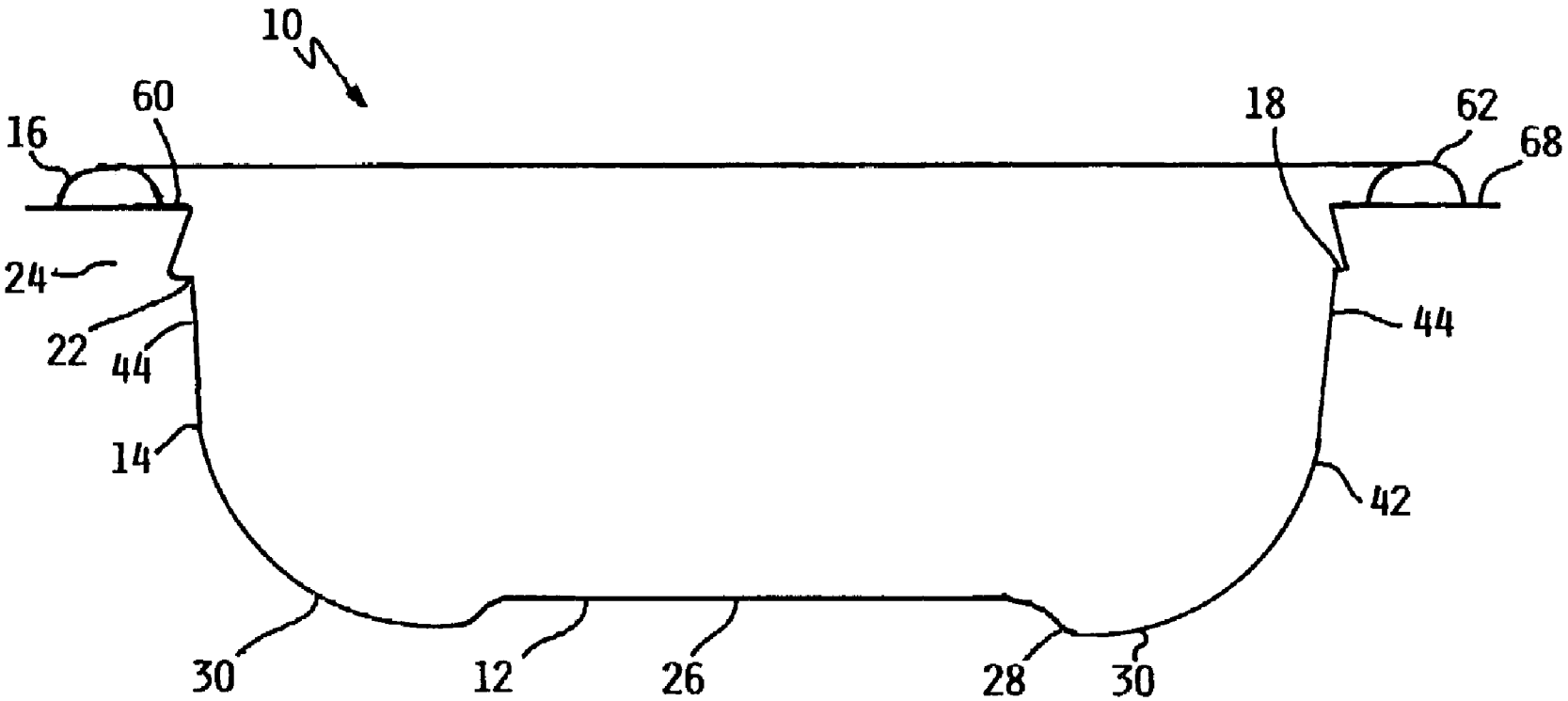
FIG. 4 shows a side cross-sectional view of the microwaveable container pursuant to the invention.

Rim 18 is disposed between the flange 16 and the top of the sidewall 14. Rim 18 includes a collar 22 that extends radially outward relative to the interior of the container 10. Rim 18 also includes a stacking wall 24 extending from collar 22 of rim 18 to flange 16. In one embodiment, stacking wall 24 may be located 90 degrees from bottom 12. In another embodiment, stacking wall 24 may be slanted inwardly relative to the bottom of the container as shown in FIG. 4.

Sidewall 14, flange 16, and rim 18 are uniquely configured to provide torsional support when container 10 is lifted. Container 10 can incorporate different wall thicknesses. In one embodiment, container 10 has a wall thickness from about 0.0006 to about 0.05 inches. In another embodiment, container 10 has a wall thickness from about 0.008 to about 0.010 inches. Flange 16 comprises a diameter from about 3 inches to about 10 inches. In one embodiment, flange 16 comprises a diameter from about 5 inches to about 6.5 inches. Rim 18 comprises a diameter from about 2 inches to about 9 inches. In one embodiment, rim 18 comprises a diameter from about 4 inches to about 6 inches.

Throughout this specification, directional terminology, such as "top," "bottom," "upwardly," "downwardly," "above," "below," etc. is used with reference to the preferred upright orientation of container 10 in FIG. 3. However, container 10 can be positioned in a wide variety of different orientations, such that the directional terminology does not limit the invention.

Figure 2:
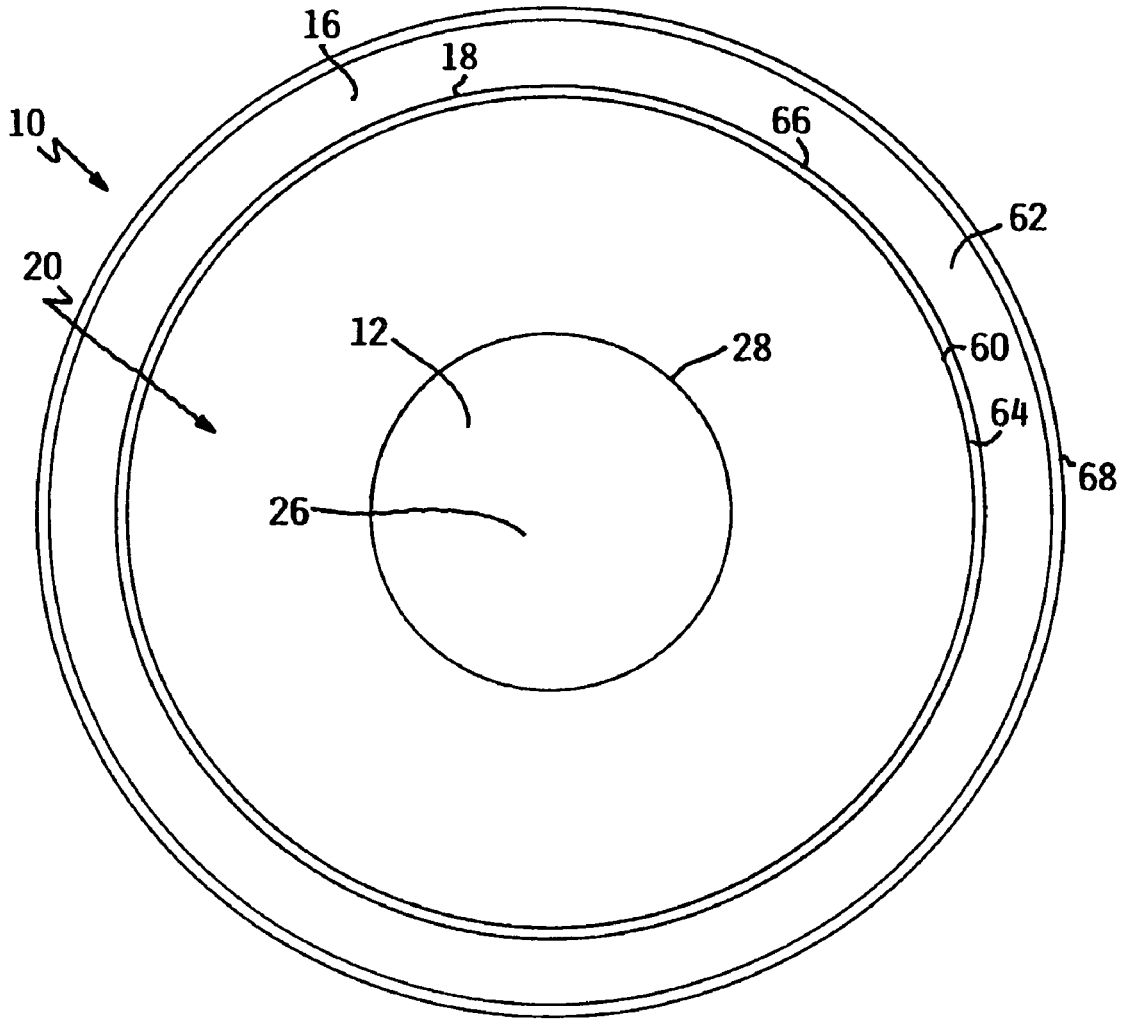
FIG. 2 shows a top plan view of a microwaveable container pursuant to the invention.

As shown in FIG. 2, container 10 is generally round. However, container 10 may also be oval without departing from the scope of the invention. A circular or oval configuration is useful for maximizing the microwave energy absorption of the contents of the container. In an alternative embodiment, container may be square, hexagonal, or the shape of any other polygon while remaining within the scope of the invention.

Figure 3:
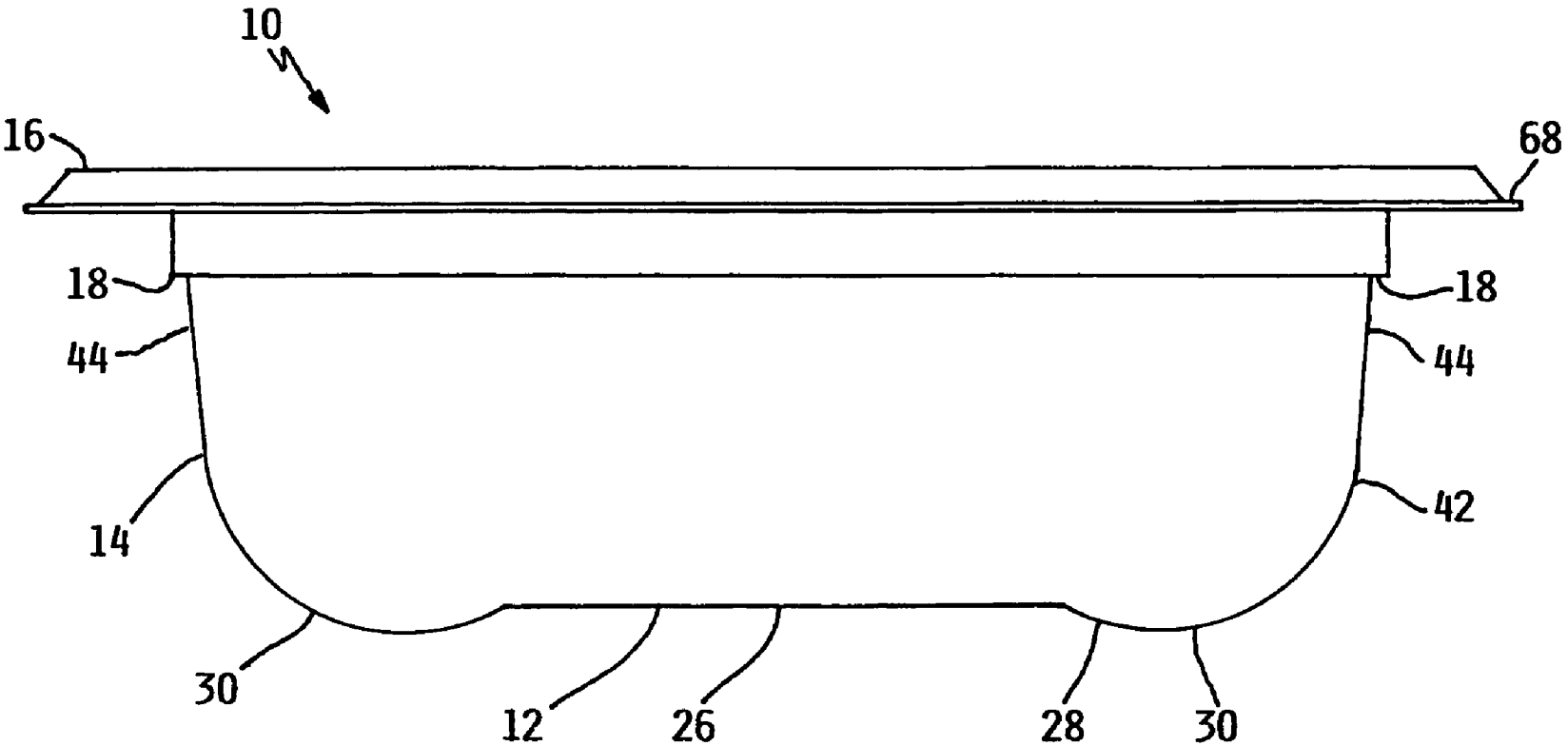
FIG. 3 shows a side elevational view of the microwaveable container pursuant to the invention.

As shown in FIGS. 3 and 4, bottom 12 is generally flat near center 26 of bottom 12. The flat section of bottom 12 ends at periphery 28. A curved section 30 is disposed between periphery 28 and sidewall 14.

Container 10 rests on curved section 30 to promote stable placement of container 10 on a table top, in a microwave oven or on another flat surface. In an alternative embodiment, bottom 12 may be concaved upwardly or inwardly relative to the interior 20 to further enhance microwave interaction with food items in the container 10.

Sidewall 14 is continuous, extending from the bottom 12. In this regard, sidewall 14 is defined by a curved section 30, an intermediate section 42 and an upper section 44. Curved section 30 extends from bottom 12. Intermediate section 42 extends between curved section 30 and upper section 44. Finally, upper section 44 terminates in collar 22 of rim 18.

The outer portion of curved section 30 extends radially outwardly and upwardly from bottom 12. In particular, curved section 30 is curved in transverse cross-section (or "transversely curved"). With respect to the central axis of container 10, curved section 30 forms a convex curve. Moreover, curved section 30 defines a transverse, cross-sectional radius in the range of from about 0.25 to about 1.5 inch. However, a radius in the range of from about 0.8 to about 1.0 inch promotes the overall stability and torsional resistance of container 10.

Intermediate section 42 extends generally upwardly from curved section 30, and is linear in transverse cross-section. As shown in FIGS. 3 and 4, however, intermediate section 42 forms a slight radial projection outward from bottom to top relative to the central axis in transverse cross-section. Thus, a transverse cross-sectional length and width of the container 10 along intermediate section 42 is greater at a top portion thereof as compared to adjacent curved section 30. In an alternative embodiment, intermediate section 42 defines a radius of about 5 degrees. In yet another alternative embodiment, the cross-sectional shape of intermediate section 42 may be straight.

Finally, upper section 44 extends from intermediate section 42, and defines a collar 22 and stacking wall 24 of rim 18. Collar 22 extends radially outwardly from upper section 44. Stacking wall 24, in turn, extends generally upwardly from collar 22 and terminates at flange 16. In one embodiment, stacking wall 24 defines, in transverse cross-section, a slight inward taper from bottom to top, relative to the central axis. With this configuration, upper section 44 promotes stacking of another, similarly formed container (not shown) within container 10, but prevents the second container from entirely nesting within container 10, with collar 22 of the second container resting on flange 16. If the second container were allowed to fully nest within container 10, frictional forces would prevent easy disassembly of the second container from container 10.

With reference to FIG. 1, flange 16 extends from stacking wall 24 of rim 18 and is generally defined by an edge section 60 and an upper section 62. As best shown by FIGS. 2 and 3, edge section 60 extends radially outwardly from stacking wall 24 of rim 18 terminating at lip 66. Edge section 60 of the invention forms a relatively flat outer surface 64, which is useful for slowing a food product during baking.

Upper section 62 extends from lip 66 of edge section 60 opposite sidewall 14. As depicted in FIGS. 3 and 4, upper section 62 extends around the exterior of container 10, generally downwardly relative to edge section 60, and radially outward relative to sidewall 14. This aspect of the invention has been found to enhance the overall stability and ease of handling of the container 10.

Upper section 62 defines a cross sectional radius as shown in FIG. 4. This cross sectional radius extends around the perimeter of the container 10. In one embodiment, upper section 62 defines a radius measuring from about 0.1 to about 0.5 inches. In another embodiment, upper section 62 defines a radius measuring about 0.241 inches. It is believed that this relatively small radius, within the critical range, contributes to overall stability and ease of handling of container 10 while reducing the amount of space required to store nested empty containers 10 and full packaged containers 10.

The outer periphery of flange 16 includes ring 68. Ring 68 is relatively flat compared to the surface of upper section 62. In one embodiment, ring 68 is located in a plane that is parallel to edge section 60. In another embodiment, ring 68 is located in the same plane as edge section 60.

Flange 16 provides a relatively large spacing between edge section 60 and ring 68, thereby dissipating and buffering the amount of heat transferred from sidewall 14, through upper section 62, to ring 68, while not noticeably increasing manufacturing costs. This configuration also controls bubble up of a food product during microwave baking. When the batter reaches collar 22, the batter will rise more slowly until reaching edge section 60. Batter may rest on edge section 60 and a portion of upper section 62 that is adjacent to edge section.

Upon completion of the baking cycle, a user may remove the container from the microwave by grasping opposing sides of container 10 at the portions of upper section 62 that are adjacent to ring 68. Because the configuration of container 10 minimizes product bubble-up over the upper section 62 the consumer will be less likely to experience discomfort when removing container 10 from the microwave.

Both flange 16 and rim 18 define compound curves as previously described. This characteristic provides container 10 with an elevated level of torque resistance when a lifting force is applied at a single point along flange 16. Following heating, container 10 is preferably lifted by a user (not shown) via flange 16. In the event the user inadvertently lifts container 10 with a single hand, the compound curvature nature of flange 16 and rim 18 resist deflection or bending of container 10 due to a weight of the contained food item (not shown).

Figure 5:
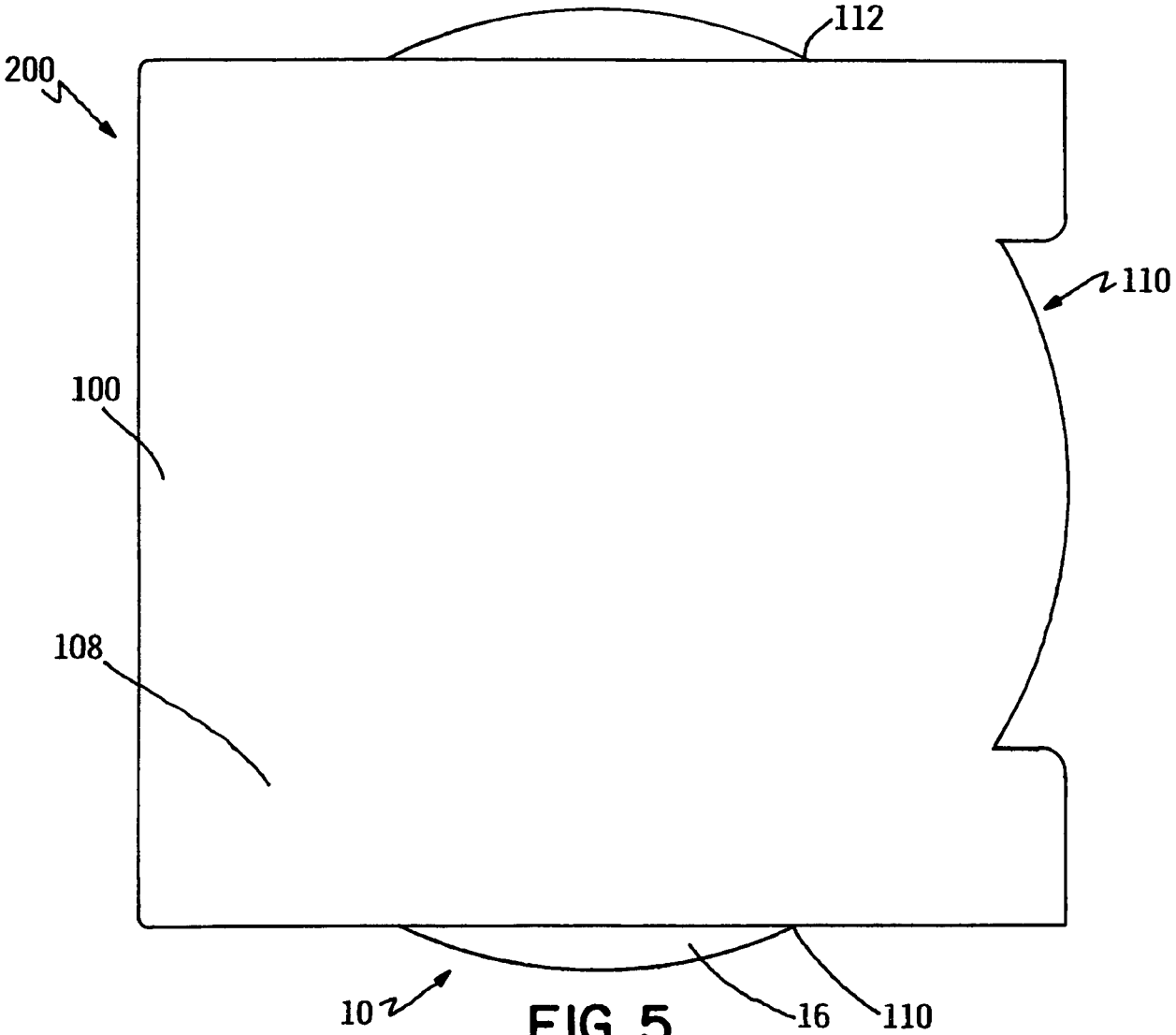
FIG. 5 shows a top plan view of a packaging sleeve pursuant to the invention.
Figure 6:
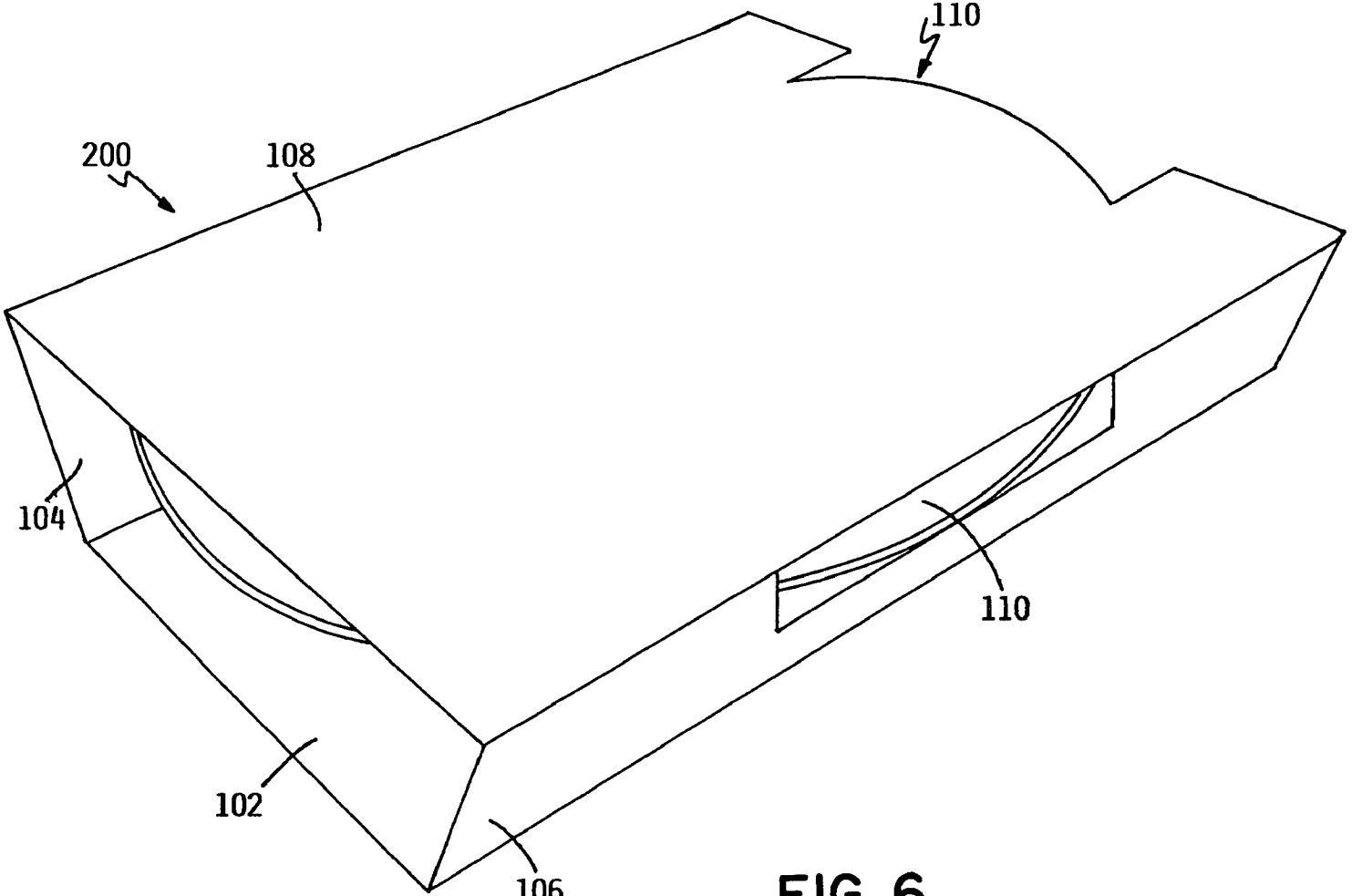
FIG. 6 shows an isometric view of the packaging assembly pursuant to the invention.

With reference to FIG. 5, sleeve 100 and the shape of packaging sleeve 100 will now be discussed. In this example embodiment, sleeve 100 is a box-shaped container made of paperboard or a similar paper product. Sleeve 100 includes a sleeve base 102, two depending sleeve sides 104, 106, and a sleeve top 108. Indent 110 is disposed in the top 108 of sleeve 100, to facilitate removal of the container 10 from sleeve 100.

Sleeve 100 is designed to hold container 10 firmly in place within sleeve 100. With reference to FIG. 5, aperture 110 is disposed through side 106. Similarly, aperture 112 is disposed through side 104. However apertures 110 and 112 may also extend onto top 108. Apertures 110 and 112 facilitate the locking of container 10 in sleeve 100 as sides 106 and 108 interfere with opposing sides of the flange 16 of container 10.

When container 10 is located in sleeve 100, assembly 200 is formed. During packaging, the food distributor places food products, preferably a dry mix or other components, in container 10. The food products may be wrapped in a separate package and placed in container 10. Alternatively, a heat seal (not shown) may be placed over container 10 to seal the dry mix in the interior 20. In yet another embodiment, a shrink wrap may be disposed over container 10 to hold the ingredients in the interior 20. Next, the sealed container 10 is placed on the base 102 of sleeve 100. Next, sides 104 and 106 are wrapped around container 10 so that flange 16 extends at least partially through apertures 110 and 112 respectively and the flange 16 of container 10 catches the sides 104 and 106 of the sleeve. After the container is in place as described, top 108 is folded over container 10 and secured against side 106 and side 104. In this configuration, flange 16 of container 10 extend at least partially through apertures 110 and 112 to lock the container 10 in sleeve 100 as shown in FIG. 5. An adhesive may be disposed on top 108 or base 102 to further secure sleeve 100. Next, assembly 200 is ready for distribution in the marketplace. This configuration of assembly 200 provides sufficient interference to prevent containers 10 from inadvertently sliding out of the assembly 200 during distribution or storage.

After the assembly 200 is packed, sleeve 100 protects container 10 and ensures that the contents of container 10 remain within interior 20. It also helps provide a tamper-evident package that displays nutritional information, ingredients, heating instruction, and other information. Sleeve 100 also safeguards the containers by acting as a protective layer during shipping and also when the tray is displayed on the shelf, freezer, refrigerator, or other display area. For this reason, sleeve top 108 is typically a continuous piece that is free of any apertures.

Once assembly 200 is purchased, the consumer may place the assembly in a home pantry, freezer or refrigerator until the consumer wishes to cook the food in container 10. When the consumer desires to prepare the food in container 10 for consumption, the consumer removes container 10 from assembly 200 by tearing sleeve 100. Sleeve 100 may include a zip tag, or other apparatus to separate container 10 from sleeve 200.

Once container 10 is removed from the assembly 200, it is ready for preparation and microwave baking. The contents of the container, typically a dry mix, are emptied into interior 20 of container 10. Suitable dry mixes are disclosed in U.S. Pat. Nos. 4,396,635 and 4,419,377 which are incorporated herein by reference in their entireties.

In one embodiment, the user stirs about 1.33 tablespoons of water into the dry-mix with a spoon, scraping mix and batter from the side of container 10 until all of the mix is moistened. Next, nuts can be sprinkled over the batter. The container 10 is then heated in a microwave uncovered on high for a predetermined amount of time until most of the surface of the food product looks dry. A user then removes the container 10 from the microwave by grasping flange 16 on opposing sides of the container 10. Container 10 is allowed to stand on a heatproof surface for 2 minutes until the food product cools.

In addition to, or in place of nuts, a wide variety of components can be added to the batter. These components can include flavorings, fillings or color particulates, and can be sprinkled or ribboned over the batter. Frosting can be applied to the top of the finished cake.

The container 10 and sleeve 100 of the invention provides a marked improvement over previous designs. More particularly, the container is well suited for pre-made food packaging and heating applications, in that a thermoformed plastic is utilized such that overall costs are minimized. To this end, a wide variety of food items can be contained and heated within container 10, including cake mixes, desserts, etc. Further, container 10 provides improved heat deflection at flange 16 and is essentially reinforced against torsional forces generated when the container is lifted by a single hand following heating within an oven.

Although the present invention has been described with reference to preferred embodiments, workers of ordinary skill will recognize that changes can be made in form and detail without departing from the spirit and scope of the present invention.

What is claimed is:

1. A container for use in microwave heating, the container comprising:

a bottom;

a sidewall defining an interior, the sidewall extending upwardly from the bottom and terminating at a rim having a collar;

a stacking wall extending upwardly and radially inwardly from the rim;

a flange extending from the stacking wall, the flange including:

an edge section extending radially outwardly from said stacking wall and terminating at a lip, whereby the edge section and lip define an outer surface positioned above the stacking wall and configured to slow a food product during baking; and an upper section extending radially outward from the container.

2. The container of claim 1, wherein the sidewall includes a curved section, a intermediate section, and an upper section, wherein a portion of the curved section is located below the bottom.

3. The container of claim 2, wherein the sidewall has a thickness of from about 0.006 to about 0.05 inches.

4. The container of claim 3, wherein the curved section defines a cross sectional radius of from about 0.25 to about 1.5 inches.

5. The container of claim 4, wherein the upper section defines a cross sectional radius measuring from about 0.1 to about 0.5 inches.

6. The container of claim 5, wherein the container is round.

7. The container of claim 6 further comprising a ring extending radially outward from the upper section.

8. The container of claim 7, wherein the ring is located in a plane substantially parallel to the edge section.

9. The container of claim 8, wherein the ring is located in a plane substantially parallel to the collar.

10. The container of claim 9, wherein an intermediary food product is adapted to be disposed in the interior of the container.

11. A food package kit comprising:

a container including:

a bottom;

a sidewall defining an interior, the sidewall extending upwardly from the bottom and terminating at a rim having a collar;

a stacking wall extending upwardly and radially inwardly from the rim;

a flange extending from the stacking wall, the flange including:

an edge section extending radially outwardly from said stacking wall and terminating at a lip, whereby the edge section and lip define an outer surface positioned above the stacking wall and configured to slow a food product during baking; and an upper section extending radially outward from said lip, wherein said upper section defines a cross sectional radius about the exterior of the container;

at least one intermediary food product disposed in the container;

a sleeve holding the container therein, the sleeve including a sleeve top and a sleeve base, wherein the sleeve contains an aperture, wherein a portion of the flange is disposed through the aperture.

12. The kit of claim 11, wherein the sleeve includes a first side disposed between the sleeve top and the sleeve base, wherein the aperture is disposed on the first side.

13. The kit of claim 12, wherein the sleeve includes a second side disposed between the sleeve top and the sleeve base, wherein a second aperture is disposed on the second side.

14. The kit of claim 13, wherein the container is located between the first side and the second side, wherein the flange is at least partially disposed between the first aperture and the second aperture.

15. The kit of claim 14, wherein the sleeve includes a zip tag for removing the container from the sleeve.

16. The kit of claim 15, wherein the sleeve includes instructions for preparing a dry mix.

17. The kit of claim 11, further comprising a sealing film for holding a dry-mix in the container.

18. The kit of claim 11, wherein the flange defines a diameter of from about 3 inches to about 10 inches.

19. A food package kit comprising:

a container including:

a bottom a sidewall defining an interior, the sidewall extending upwardly from the bottom and terminating at a rim having a collar;

a stacking wall extending upwardly and radially inwardly from the rim;

a flange extending from the stacking wall, the flange including:

an edge section extending radially outwardly from said stacking wall and terminating at a lip, whereby the edge section and lip define an outer surface positioned above the stacking wall and configured to slow a food product during baking; and an upper section extending radially outward from the container;

at least one intermediary food component proximate to the container; and a means for maintaining the intermediary food component proximate to the container.

20. The food package kit of claim 19, further comprising a sleeve configured to hold the container therein, the sleeve including a sleeve top and a sleeve base, wherein the sleeve contains an aperture, wherein a portion of the flange is disposed through the aperture.

* * * * *